US006202644B1

(12) United States Patent
Takeuchi et al.

(10) Patent No.: US 6,202,644 B1
(45) Date of Patent: Mar. 20, 2001

(54) DIVING SNORKEL

(75) Inventors: Minoru Takeuchi; Kenji Kawana, both of Sumida-ku (JP)

(73) Assignee: Tabata Co., Ltd. (JP)

( * ) Notice: Subject to any disclaimer, the term of this patent is extended or adjusted under 35 U.S.C. 154(b) by 0 days.

(21) Appl. No.: 09/245,679

(22) Filed: Feb. 8, 1999

(30) Foreign Application Priority Data

Feb. 18, 1998 (JP) ..... 10-036158

(51) Int. Cl.[7] ..... B63C 11/16
(52) U.S. Cl. ..... 128/201.11; 128/201.27
(58) Field of Search ..... 128/201.11, 201.26, 128/201.27, 201.28, 200.29, 205.24, 206.29, 201.29

(56) References Cited

U.S. PATENT DOCUMENTS 4,860,739 * 8/1989 Vandepol ..... 128/201.11
4,884,564 * 12/1989 Lamont ..... 128/201.11
5,199,422 * 4/1993 Rasocha ..... 128/201.11
5,267,556 * 12/1993 Feng ..... 128/201.11
5,280,785 * 1/1994 Fujima ..... 128/201.11
5,529,057 * 6/1996 Ferrero et al. ..... 128/201.11
5,865,169 * 2/1999 Lan et al. ..... 128/201.11
6,119,685 * 9/2000 Kawashima et al. ..... 128/201.11
6,129,081 * 10/2000 Wu ..... 128/201.11

FOREIGN PATENT DOCUMENTS 2536368 2/1997 (JP) .

* cited by examiner

*Primary Examiner*—John G. Weiss
*Assistant Examiner*—Teena Mitchell
(74) *Attorney, Agent, or Firm*—Baker & Daniels

(57) ABSTRACT

A diving snorkel provided in the proximity of at least one of an upper opening and a mouthpiece with at least one partition extending from an inner wall of a snorkel conduit and also extending longitudinally of the conduit so as to compartmentalize the conduit in its circumferential direction, and thereby enable undesirable inflow of water to be obstructed as effectively as possible and enable efficient purging of water which enters into the snorkel.

16 Claims, 5 Drawing Sheets

DIVING SNORKEL

BACKGROUND OF THE INVENTION

This invention relates to diving snorkels such as used by divers or swimmers.

Conventional snorkels comprise a snorkel conduit provided with an upper opening lying above the water surface during actual use of the snorkel, a mouthpiece lying under the water surface during actual use of the snorkel, and a lower opening including a non-return valve adapted to be opened downwards and lying under the water surface during actual use of the snorkel.

The known snorkel, for example, from Japanese Utility Model Registration Gazette No. 2536368 usually has its upper opening defined by a first tubular portion and a second tubular portion extending in parallel to each other. These first and second tubular portions are laterally communicate with each other via a passage. Between the first tubular portion and the second tubular portion, the conduit is substantially in a curved condition so that undesirable inflow of water into the mouthpiece through the upper opening can be obstructed as reliably as possible.

A quantity of water having flowed into the snorkel through the upper opening lying above the water surface during actual use of the snorkel must be forced out by a swimmer's expiration. Consequently, a larger quantity of water inflow will correspondingly increase a swimmer's physical fatigue. To alleviate such physical fatigue, it is required for the snorkel of well known art to obstruct the inflow of water through the upper opening as effectively as possible. While the snorkel of well known art intends to achieve this by curving the conduit, its inflow obstructing ability is not satisfactory.

Commonly to the conventional snorkels inclusive of the above-mentioned snorkel of prior art, a quantity of water staying immediately below the mouthpiece often generates turbulence as a swimmer attempts to purge out a quantity of water remaining within the snorkel by vigorous expiration. Such phenomenon may prevent the quantity of water from rapidly moving toward the upper opening. The expiration for purge thus utilized in vain will further increase the swimmer's physical fatigue.

SUMMARY OF THE INVENTION

In view of the problem as has been described above, it is an object of the invention to alleviate a swimmer's physical fatigue inevitably caused by the conventional snorkel and to eliminate the cause of such physical fatigue.

According to the present invention, there is provided a diving snorkel comprising a snorkel conduit provided with an upper opening, a lower opening a mouthpiece, and a non-return valve adapted to be opened downwards, wherein the snorkel conduit is provided in the proximity of at least one of the upper opening and the mouthpiece with at least one partition extending inwardly from an inner wall of the conduit and also extending longitudinally of the conduit so that the conduit is circumferentially comparmented by the partition.

According to one embodiment of present invention, the partition formed in the proximity of the mouthpiece lies in a region of the inner wall of the conduit opposed to a breathing seat of the mouthpiece.

DESCRIPTION OF THE PREFERRED EMBODIMENTS

Details of a snorkel according to the invention will be more fully understood from the description given hereunder with reference to the accompanying drawings.

Figure 1:
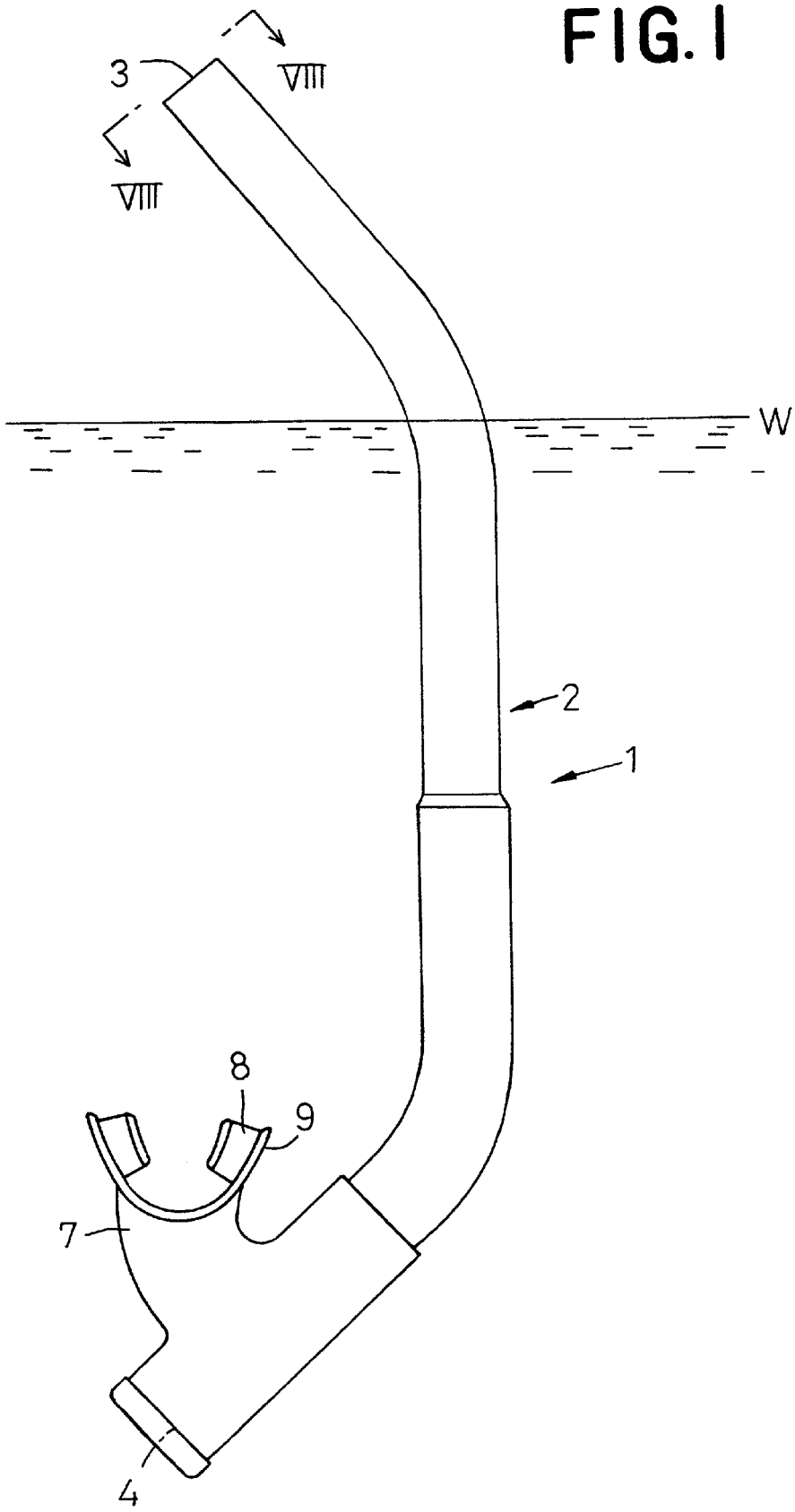
FIG. 1 is a side view of a snorkel according to a principle of the invention.

FIG. 1 is a side view showing a snorkel 1 and a position of water surface W during actual use of the snorkel 1. The snorkel 1 comprises a snorkel conduit 2 extending vertically of the figure and this snorkel conduit 2 has an upper opening 3 and a lower opening 4 provided, in turn, with a non-return valve 6 which will be described later in more detail. In the proximity of the lower opening 4, a branch conduit 7 extends upward from the conduit 2 and an upper end of this branch conduit 7 forms a mouthpiece 9 provided with a pair of bit-projections 8.

The snorkel 1 allows a swimmer to breathe through the mouthpiece 9 held in his or her mouth by means of the bit-projections 8 so that a quantity of air aspirated by the swimmer may be taken in through the upper opening 3 lying above the water surface W and a quantity of air expired by the swimmer may be forced out also through the upper opening 3. A quantity of water having flowed into the snorkel 1 can be forced out through the upper opening 3 by instantaneous vigorous expiration of the swimmer. When the swimmer who has made a deep dive thereafter rises again toward the water surface W until the snorkel 1 restores its position as shown in FIG. 1, a quantity of water contained in the snorkel 1 which is now partially exposed above the water surface W has a pressure sufficient to open the non-return valve 6 and the quantity of water is purged out through the drainage opening 4. A quantity of water remaining within the snorkel 1 is then forced out by the swimmer's expiration.

Figure 2:
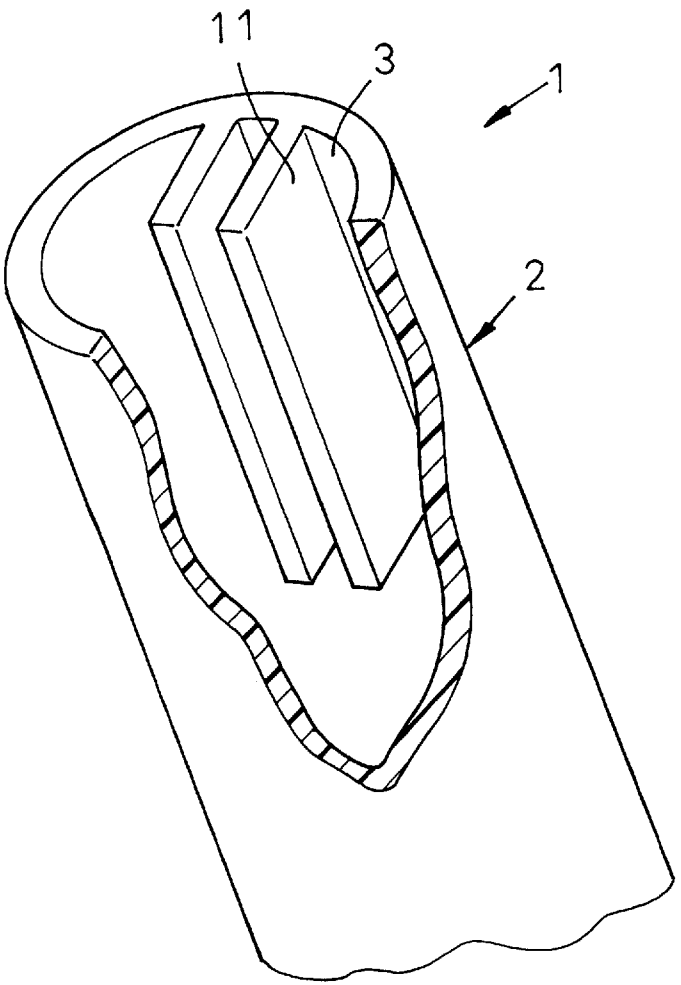
FIG. 2 is a perspective view showing an upper portion of the snorkel as partially broken away.

FIG. 2 is a perspective view of the conduit 2 in the proximity of the upper opening 3 as partially broken away. Within the conduit 2, there is provided partitions 11 extending inwardly from the inner wall radially or parallel to one another and extending from the opening 3 longitudinally of the conduit 2 so that the partitions 11 may circumferentially compartmentalize an inner space of the conduit 2. When a plurality of such partitions 11 are provided as shown, they may be formed so as to extend in parallel one to another longitudinally of the conduit 2. The partitions 11 serve as baffle plates adapted to obstruct undesirable inflow of water, on one hand, and to rectify a stream of water forced out by expiration or a stream of fresh air taken in by aspiration of the swimmer both through the upper opening 3, on the other hand. Breathing of the swimmer is thereby facilitated.

Figure 3:
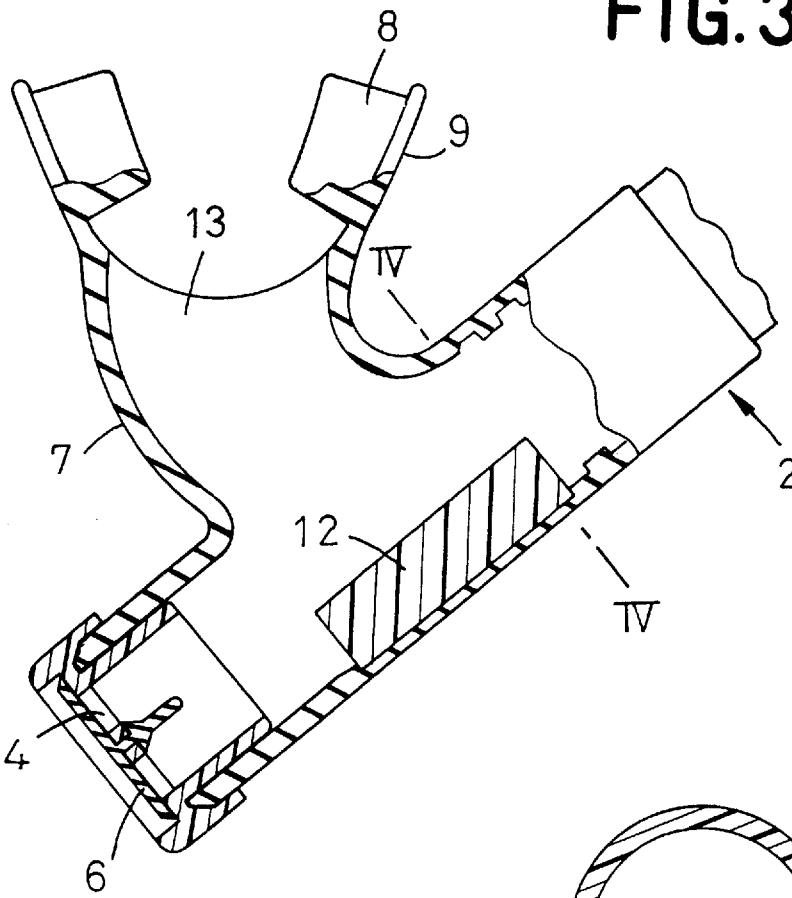
FIG. 3 is a side view showing the snorkel in the proximity of a mouthpiece as partially broken away.
Figure 4:
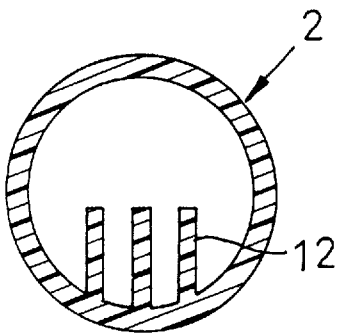
FIG. 4 is a sectional view taken along a line IV—IV in FIG. 3.

FIG. 3 is a side view of the snorkel 1 in the proximity of the mouthpiece 9 as partially broke away and FIG. 4 is a sectional view taken along a line IV—IV in FIG. 3. The mouthpiece 9 includes a breathing seat 13 directly communicating with the branch conduit 7 and the inner wall of the conduit 2 facing the breathing seat 13 is formed with second partitions 12. The partitions 12 extend inwardly from the inner wall radially or parallel to one another and also longitudinally of the conduit 2 so that they may circumferentially compartmentalize the conduit 2. While there may be provided at least one second partition 12, if it is desired to provide a plurality of such second partitions 12, as shown, they may be arranged so as to extend in parallel one to another longitudinally of the conduit 2. With the snorkel 1 having such second partitions 12, the swimmer's vigorous expiration can efficiently force out a quantity of water contained within the conduit 2. This is for the reason that a quantity of water remaining immediately below the breathing seat 13 can be rectified along the second partitions 12 without generation of any turbulence and rapidly moved toward the upper opening 3. In this manner, the swimmer's expiration can be efficiently utilized to purge out the quantity of water and the swimmer's fatigue can be correspondingly alleviated.

The lower opening 4 at the bottom of the conduit 2 is provided with a non-return valve 6 mounted thereon from outside of the conduit 2. The nonreturn valve 6 is made of a soft elastic material and adapted to be opened downwards.

Figure 5:
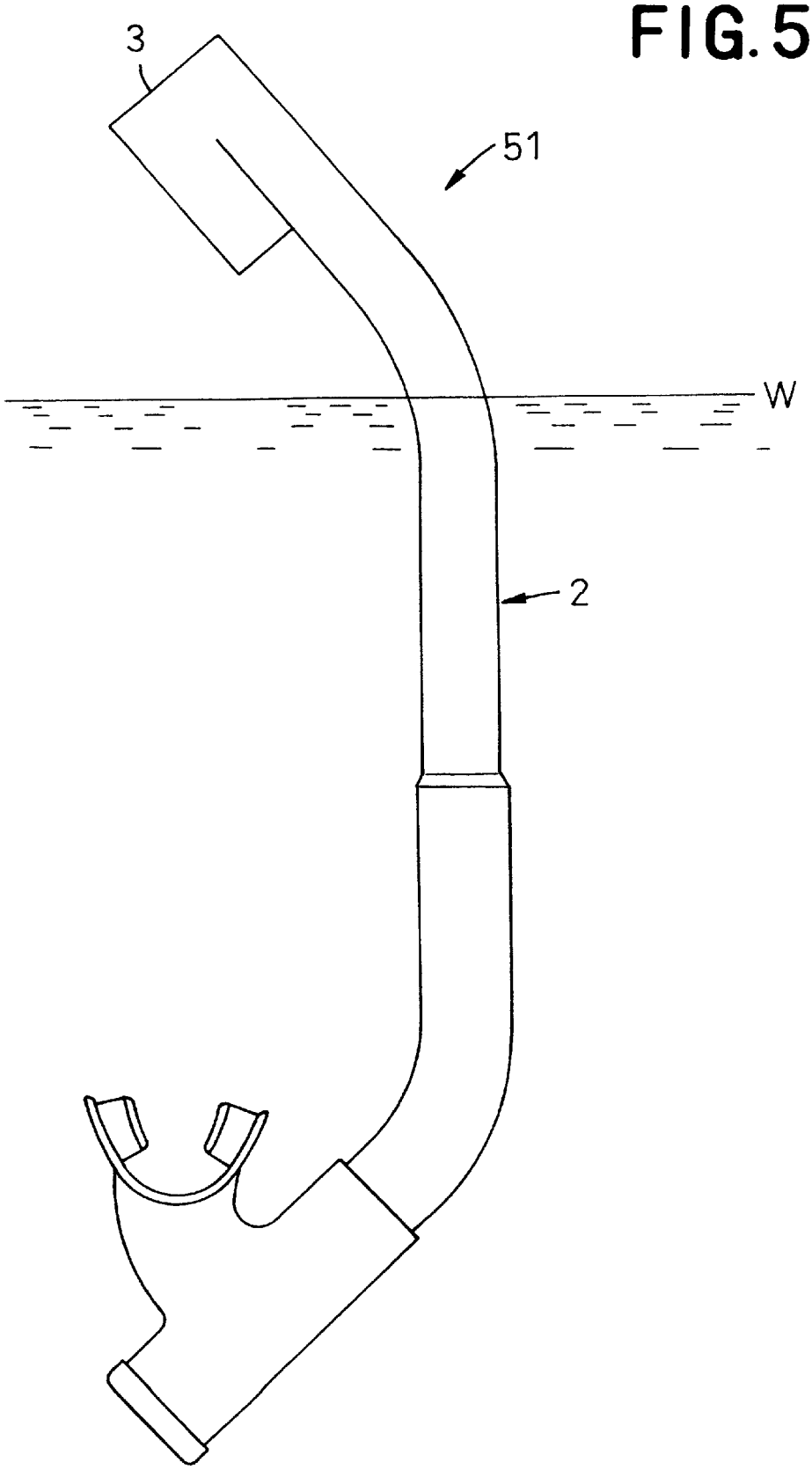
FIG. 5 is a view similar to FIG. 1, showing an alternative embodiment of the invention.
Figure 7:
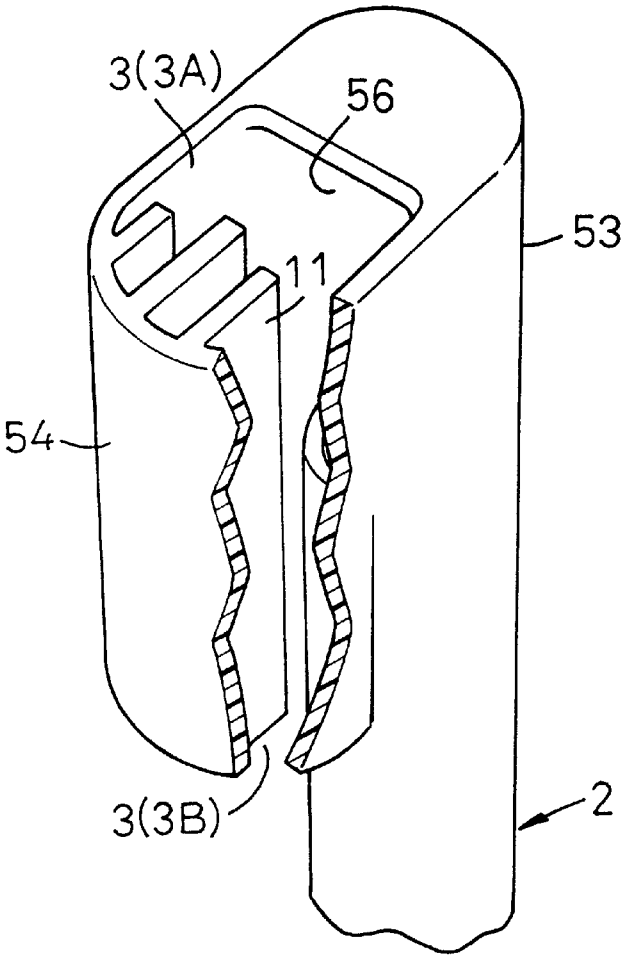
FIG. 7 is a perspective view showing the upper portion of the snorkel shown in FIG. 5 as partially broken away.
Figure 6:
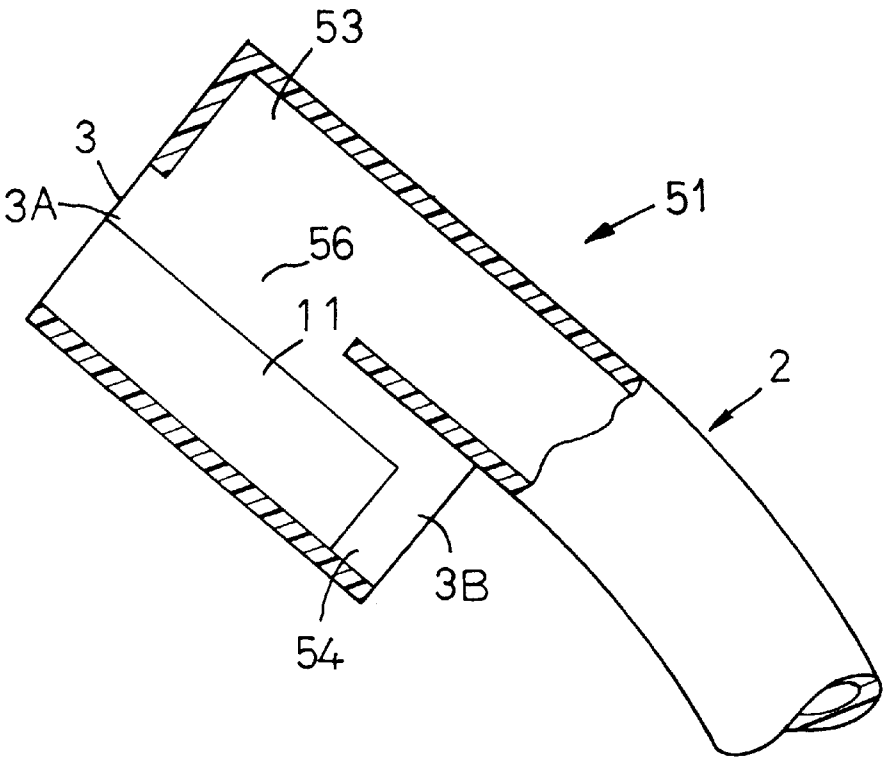
FIG. 6 is a side view showing an upper portion of the snorkel shown in FIG. 5 as partially broken away.
Figure 8A:
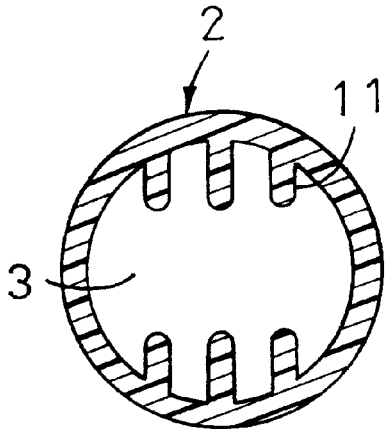
FIG. 8 is a sectional view taken along a line VIII—VIII in FIG. 1, showing various embodiments (A)~(D).
Figure 8B:
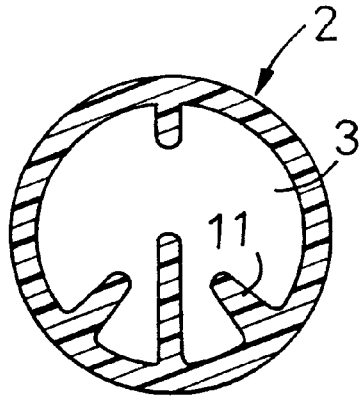
Figure 8C:
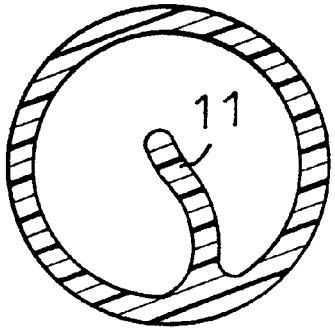
Figure 8D:
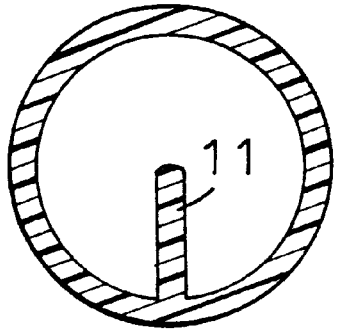

FIG. 5 is a side view showing a snorkel 51 according to an alternative embodiment of the invention, FIG. 6 is a side view of this snorkel 51 in the proximity of the upper opening 3, viewed as partially broken away, and FIG. 7 is a perspective view corresponding to FIG. 6 as partially broken away. Except for the portion in the proximity of the upper opening 3, the snorkel 51 is similar to the snorkel 1 shown in FIG. 1. The arrangement of the snorkel 51 in the proximity of the upper opening 3 is substantially the same as the arrangement disclosed in the previously mentioned Japanese Utility Model Registration Gazette No. 2536368. Specifically, the top of the conduit 2 is actually defined by a first tubular portion 53 and a second tubular portion 54 extending in parallel to the first tubular portion 53, these tubular portions 53, 54 laterally communicate with each other via a passage 56. The upper opening 3 comprises two openings 3A, 3B formed at upper and lower ends of the second tubular portions 54, respectively, so that draft/purge can occur through both of these two openings 3A, 3B. The inner wall of the second tubular portion 54 is provided with a plurality of first partitions 11 extending inwardly from a region of the inner wall opposed to the passage 56 radially or parallel to one another and also longitudinally of the second tubular portion 54. The first partitions 11 function not only to obstruct undesirable inflow water through the upper opening 3 but also to rectify a stream of water entering into the second tubular portion in the vertical direction and thereby to make it difficult for this stream of water to scatter toward the first tubular portion 53.

The snorkel 51 shown is provided with the first partitions 11 adapted to obstruct undesirable inflow of water and the second partitions 12 adapted to improve a purge efficiency achieved by a swimmer's expiration. Therefore, both the first partitions 11 and the second partitions 12 are effective to alleviate the swimmer's physical fatigue. It should be understood, however, that the invention may be exploited in the form of the snorkel provided with either the first or second partitions alone.

FIG. 8 shows four embodiments (A)~(D) of the first partitions 11 as viewed in the direction as indicated by arrows VIII—VIII in FIG. 1. Of FIG. 8, (A) shows an embodiment in which a pair of sets each comprising a plurality of first partitions 11 are opposed to each other in the vertical direction, each set being parallelly arranged side by side in the horizontal direction as viewed in the figure; (B) shows another embodiment in which a plurality of first partitions 11 extend toward a center of the conduit 2; (C) shows still another embodiment in which there is provided a single slightly curved first partition 11; and (D) shows further another embodiment in which there is provided a single first partition 11 extending straightly toward the center of the conduit 2.

The snorkel according to the invention can effectively alleviate a swimmer's physical fatigue by the first partitions adapted to obstruct undesirable inflow of water and by the second partitions which improve a purge efficiency achieved by the swimmer's expiration.

What is claimed is:

1. A diving snorkel comprising:

a snorkel conduit provided with:

an upper opening, a lower opening, a mouthpiece, and a non-return valve adapted to be opened downwards; and at least one partition provided in a proximity of at least one of said upper opening and said mouthpiece, said at least one partition extending inwardly from an inner wall of said snorkel conduit and also extending longitudinally of said snorkel conduit so that said snorkel conduit is circumferentially compartmented by said at least one partition, and said at least one partition includes two end edges and one side edge all of which are exposed within the snorkel conduit.

2. A diving snorkel according to claim 1, wherein said at least one partition is provided in the proximity of said mouthpiece and lies in a region of said inner wall of said snorkel conduit which is opposed to a breathing seat of said mouthpiece.

3. A diving snorkel according to claim 1, wherein said at least one partition extends radially inwardly from the inner wall of said snorkel conduit.

4. A diving snorkel according to claim 1, wherein said at least one partition comprises a plurality of partitions.

5. A diving snorkel according to claim 2, wherein said at least one partition comprises a plurality of partitions.

6. A diving snorkel according to claim 3, wherein said at least one partition comprises a plurality of partitions.

7. A diving snorkel according to claim 4 wherein said plurality of partitions are parallel to one another.

8. A diving snorkel according to claim 5 wherein said plurality of partitions are parallel to one another.

9. A diving snorkel according to claim 6 wherein said plurality of partitions are parallel to one another.

10. A diving snorkel according to claim 1 wherein at least one partition is provided in proximity of said upper opening and another at least one partition is provided in proximity of said mouthpiece.

11. A diving snorkel according to claim 10, wherein said at least one partition and said another at least one partition each comprise a plurality of partitions.

12. A diving snorkel according to claim 11, wherein said plurality or partitions in proximity of said upper opening are parallel to one another and the plurality of partitions provided in proximity of said mouthpiece are parallel to one another.

13. A diving snorkel according to claim 10, further comprising a second snorkel conduit section coupled to the snorkel conduit adjacent the upper opening thereof, and wherein said at least one partition is provided in said second conduit section.

14. A diving snorkel according to claim 13, wherein said at least one partition and said another at least one partition each comprise a plurality of partitions.

15. A diving snorkel according to claim 14, wherein said plurality or partitions in proximity of said upper opening are parallel to one another and the plurality of partitions provided in proximity of said mouthpiece are parallel to one another.

16. A diving snorkel according to claim 10, wherein said at least one partition is provided in the proximity of said mouthpiece and lies in a region of said inner wall of said snorkel conduit which is opposed to a breathing seat of said mouthpiece.

* * * * *